US012421972B2

(12) United States Patent
Kajie et al.

(10) Patent No.: US 12,421,972 B2
(45) Date of Patent: Sep. 23, 2025

(54) LIQUID-FEED-TYPE GAS COMPRESSOR

(71) Applicant: HITACHI INDUSTRIAL EQUIPMENT SYSTEMS CO., LTD., Tokyo (JP)

(72) Inventors: Yuta Kajie, Tokyo (JP); Shigeyuki Yorikane, Tokyo (JP); Kenji Morita, Tokyo (JP)

(73) Assignee: HITACHI INDUSTRIAL EQUIPMENT SYSTEMS CO., LTD, Tokyo (JP)

( * ) Notice: Subject to any disclaimer, the term of this patent is extended or adjusted under 35 U.S.C. 154(b) by 0 days.

(21) Appl. No.: 18/681,111

(22) PCT Filed: Jun. 29, 2022

(86) PCT No.: PCT/JP2022/026093

§ 371 (c)(1),
(2) Date: Feb. 5, 2024

(87) PCT Pub. No.: WO2023/047750

PCT Pub. Date: Mar. 30, 2023

(65) Prior Publication Data

US 2024/0280114 A1 Aug. 22, 2024

(30) Foreign Application Priority Data

Sep. 21, 2021 (JP) ..... 2021-153094

(51) Int. Cl.
*F04D 27/00* (2006.01)
*F04B 49/02* (2006.01)
(Continued)

(52) U.S. Cl.
CPC ..... *F04D 27/006* (2013.01); *F04D 29/582* (2013.01); *F04D 29/706* (2013.01)

(58) Field of Classification Search
CPC ..... F04C 18/16; F04C 29/021; F04C 29/04; F04C 2240/81; F04C 29/0014;
(Continued)

(56) References Cited

U.S. PATENT DOCUMENTS 10,578,107 B2 3/2020 Yorikane et al.
2002/0157404 A1 10/2002 Pauwels
(Continued)

FOREIGN PATENT DOCUMENTS

CN 112752907 W 5/2021
JP 57-78790 U 5/1982
(Continued)

OTHER PUBLICATIONS

International Search Report of PCT/JP2022/026093 dated Aug. 30, 2022.
(Continued)

*Primary Examiner* — Eric J Zamora Alvarez
(74) *Attorney, Agent, or Firm* — Mattingly & Malur, PC

(57) ABSTRACT

An oil-feed-type air compressor includes a compressor main body driven by an electric motor, a separator that separates the oil from compressed air delivered from the compressor main body, an oil supply system that supplies the oil separated by the separator to working chambers of the compressor main body, an oil cooler that is disposed in the oil supply system and cools the oil by using cooling air generated by a cooling fan, and a controller. The controller stops the electric motor and the cooling fan when the continuation time of no-load operation has reached a predetermined value. Further, the controller predicts the return timing at which the electric motor is restarted, on the basis of a sensing history of the delivery-side pressure sensor, and predicts the delivery-side temperature of the compressor main body at the return timing.

3 Claims, 8 Drawing Sheets

(51) Int. Cl.
*F04C 28/28* (2006.01)
*F04D 29/58* (2006.01)
*F04D 29/70* (2006.01)

(58) Field of Classification Search
CPC ..... F04C 29/026; F04C 28/06; F04C 28/08; F04C 29/02; F04C 28/28; F04C 29/0007; F04C 2270/195; F04C 2270/24; F04C 2270/19; F04C 2270/185; F04C 2/16; F04C 28/26; F04B 39/06; F04B 39/02; F04B 39/0207; F04B 49/06; F04B 49/03; F04B 35/04; F04B 49/10; F04B 49/02; F25B 2400/23; F04D 27/00; F04D 17/10; F04D 25/06; F04D 27/006; F04D 29/582; F04D 29/706
See application file for complete search history.

(56) References Cited

U.S. PATENT DOCUMENTS

| | | | | |
|---|---|---|---|---|
| 2020/0011324 | A1 | 1/2020 | Oshiro | |
| 2020/0102950 | A1* | 4/2020 | Morita | F04C 29/021 |
| 2020/0240415 | A1* | 7/2020 | Kotani | F04B 49/20 |
| 2021/0388835 | A1* | 12/2021 | Morita | F04B 49/10 |
| 2022/0243731 | A1* | 8/2022 | Morita | F04B 39/06 |
| 2022/0260075 | A1 | 8/2022 | Okubo et al. | |

FOREIGN PATENT DOCUMENTS

| | | | | |
|---|---|---|---|---|
| JP | 02-78777 | A | 3/1990 | |
| JP | 5030547 | B2 | 9/2012 | |
| JP | 2021-072708 | A | 5/2021 | |
| WO | 2019-049415 | A1 | 3/2019 | |
| WO | WO-2020066629 | A1 * | 4/2020 | F04C 18/16 |
| WO | WO-2021002098 | A1 * | 1/2021 | F04B 39/02 |

OTHER PUBLICATIONS

International Preliminary Report on Patentability received in corresponding European Application No. PCT/JP2022/026093 dated Apr. 4, 2024.
Extended European Search Report received in corresponding European Application No. 22872507.3 dated Jun. 4, 2025.

* cited by examiner

LIQUID-FEED-TYPE GAS COMPRESSOR

TECHNICAL FIELD

The present invention relates to a liquid-feed-type gas compressor that compresses gas while supplying liquid to working chambers.

BACKGROUND ART

Patent Document 1 discloses an oil-feed-type air compressor that is one of liquid-feed-type gas compressors. The oil-feed-type air compressor of Patent Document 1 includes an electric motor, a compressor main body that is driven by the electric motor and compresses air (gas) while supplying oil (liquid) to working chambers, a separator that separates the oil from the compressed air (compressed gas) delivered from the compressor main body, an oil supply system (liquid supply system) that supplies the oil separated by the separator to the working chambers of the compressor main body, a cooling fan, and an oil cooler (liquid cooler) that is disposed in the oil supply system and cools oil by using cooling air generated by the cooling fan. Heat is generated when air is compressed in the working chambers of the compressor main body, and the temperature of the compressed air rises due to this heat. The temperature of the compressed air is suppressed by cooling the compressed air with use of the oil supplied to the working chambers of the compressor main body.

The oil-feed-type air compressor of Patent Document 1 further includes a suction throttle valve disposed on the intake side of the compressor main body, a delivery-side pressure sensor that senses the delivery-side pressure of the compressor main body, and a controller that controls the electric motor and the suction throttle valve. The controller switches the suction throttle valve from the open state to the closed state to make switching from load operation to no-load operation, when the delivery-side pressure sensed by the delivery-side pressure sensor has risen to a predetermined upper-limit value during driving of the electric motor. Further, the controller stops the electric motor when the continuation time of the no-load operation has reached a predetermined value. Thereafter, the controller restarts the electric motor and switches the suction throttle valve to the open state to make switching to the load operation, when the delivery-side pressure sensed by the delivery-side pressure sensor has lowered to a predetermined lower-limit value. Energy saving is sought through execution of the no-load operation or the stop according to the delivery-side pressure of the compressor main body.

PRIOR ART DOCUMENT

Patent Document

Patent Document 1: JP-2021-072708-A

SUMMARY OF THE INVENTION

Problem to be Solved by the Invention

Although a clear description is not made in Patent Document 1, the controller controls the cooling fan in conjunction with the electric motor, for example. That is, the controller stops the cooling fan when the continuation time of the no-load operation has reached the predetermined value and the electric motor stops. Further, the controller restarts the cooling fan when the delivery-side pressure sensed by the delivery-side pressure sensor has lowered to the predetermined lower-limit value and the electric motor restart.

During the stop of the electric motor and the cooling fan, heat of compression is not generated, and the oil is not forcibly cooled. Thus, the temperature of the oil gradually decreases through only natural heat dissipation, and the delivery-side temperature of the compressor main body also gradually decreases. Further, for example, when the stop time of the electric motor and the cooling fan is short, the electric motor is restarted without the temperature of the oil and the delivery-side temperature of the compressor main body being sufficiently lowered. As such, the amount of generated heat of the compressor main body sharply increases in association with an increase in the rotation speed of the electric motor, thus leading to a possibly that the delivery-side temperature of the compressor main body becomes excessively high.

The present invention has been made in view of the above-described matter and addresses, as one of problems, suppressing the delivery-side temperature of a compressor main body at the time of restart.

Means for Solving the Problem

In order to solve the above-described problem, a configuration set forth in the scope of claims is applied. The present application includes a plurality of means to solve the above-described problem. To cite one example thereof, a liquid-feed-type gas compressor includes an electric motor, a compressor main body that is driven by the electric motor and compresses gas while supplying liquid to working chambers, a suction throttle valve disposed on an intake side of the compressor main body, a separator that separates the liquid from the compressed gas delivered from the compressor main body, a liquid supply system that supplies the liquid separated by the separator to the working chambers of the compressor main body, a cooling fan, a liquid cooler that is disposed in the liquid supply system and cools the liquid by using cooling air generated by the cooling fan, a delivery-side pressure sensor that senses delivery-side pressure of the compressor main body, and a controller that controls the electric motor, the suction throttle valve, and the cooling fan. The controller is configured to control the suction throttle valve to make switching from load operation to no-load operation when the delivery-side pressure sensed by the delivery-side pressure sensor has risen to a predetermined upper-limit value during driving of the electric motor, and stop the electric motor when continuation time of the no-load operation has reached a predetermined value and then restart the electric motor and control the suction throttle valve to make switching to the load operation when the delivery-side pressure sensed by the delivery-side pressure sensor has lowered to a predetermined lower-limit value. In this liquid-feed-type gas compressor, the controller is configured to stop the cooling fan when the continuation time of the no-load operation has reached the predetermined value and the electric motor stop, predict a return timing at which the delivery-side pressure of the compressor main body lowers to the predetermined lower-limit value and the electric motor restarts, on the basis of a sensing history of the delivery-side pressure sensor during the stop of the electric motor or the no-load operation, predict a delivery-side temperature of the compressor main body at the return timing in a case of stopping the cooling fan until the return timing, continue the stop of the cooling fan when the predicted delivery-side temperature is equal to or lower than a predetermined acceptable value, and restart the cooling fan antecedently to the electric motor when the predicted delivery-side temperature exceeds the predetermined acceptable value.

Advantages of the Invention

According to the present invention, the delivery-side temperature of the compressor main body at the time of restart can be suppressed.

Problems, configurations, and effects other than the above-described ones will be made apparent by the following description.

MODES FOR CARRYING OUT THE INVENTION

A first embodiment of the present invention will be described with reference to the drawings.

Figure 1:
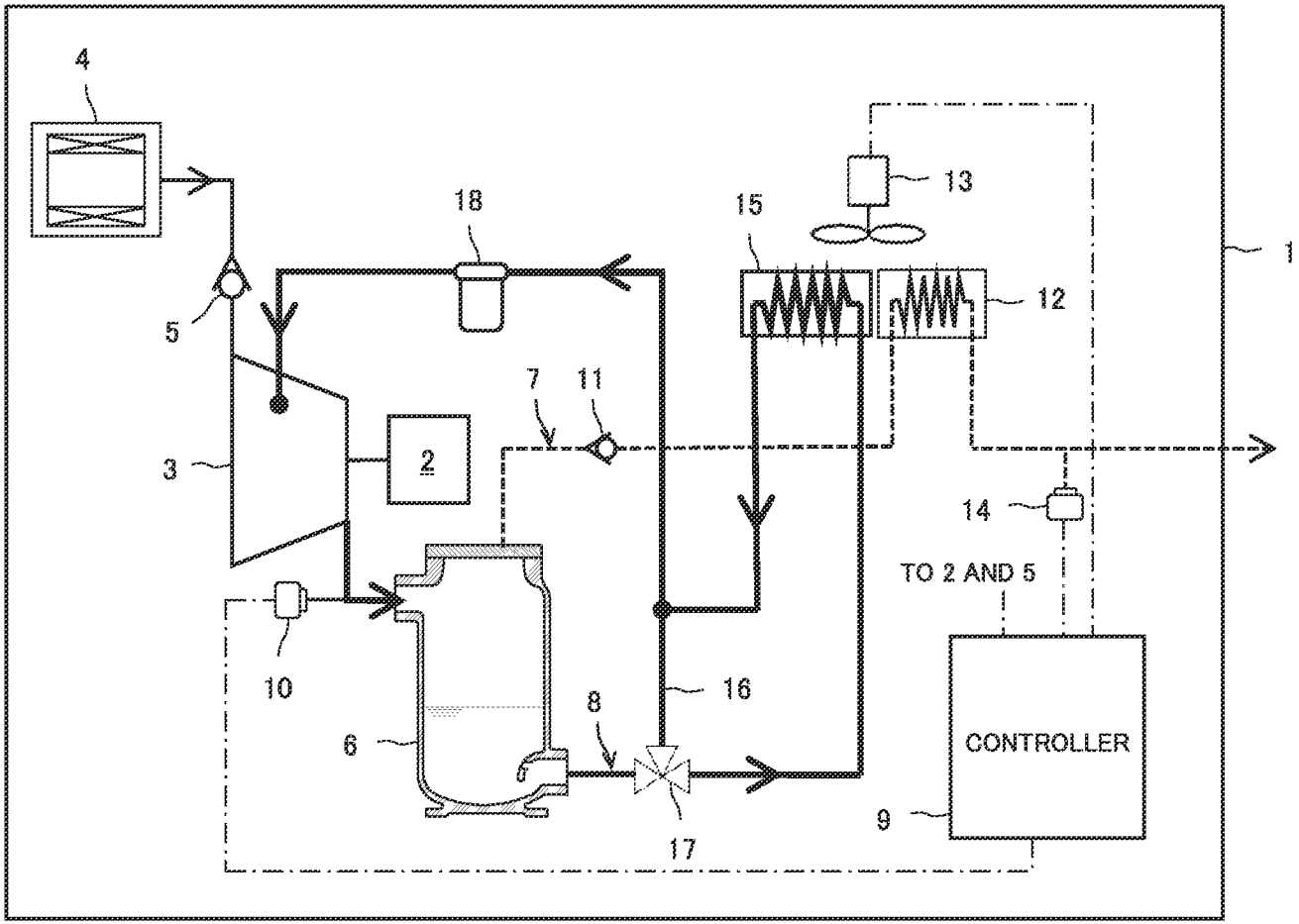
FIG. 1 is a schematic diagram that represents a configuration of an oil-feed-type air compressor in a first embodiment of the present invention.

FIG. 1 is a schematic diagram that represents a configuration of an oil-feed-type air compressor in the present embodiment.

An oil-feed-type air compressor 1 (hereinafter, simply referred to as the compressor 1) of the present embodiment includes an electric motor 2, a compressor main body 3 that is driven by the electric motor 2 and compresses air (gas) while supplying oil (liquid) to working chambers, and an air filter 4 and a suction throttle valve 5 that are disposed on the intake side of the compressor main body 3. The compressor 1 includes also a separator 6 that separates the oil from the compressed air (compressed gas) delivered from the compressor main body 3, a compressed air supply system 7 (compressed gas supply system) that supplies the compressed air separated by the separator 6 to the external of the compressor 1, an oil supply system 8 (liquid supply system) that supplies the oil separated by the separator 6 to the working chambers of the compressor main body 3, and a controller 9. The compressor 1 is configured as a unit obtained by the above-described devices being housed in a casing.

For example, the compressor main body 3 has a pair of male and female screw rotors that mesh with each other and a casing that houses the screw rotors, and a plurality of working chambers are formed in tooth grooves of the screw rotors. Each working chamber moves in the axial direction of the rotors in association with rotation of the rotors and sequentially executes an intake process of taking in air, a compression process of compressing the air, and a delivery process of delivering the compressed air. A delivery-side temperature sensor 10 is disposed between the compressor main body 3 and the separator 6. The delivery-side temperature sensor 10 senses the delivery-side temperature of the compressor main body 3 and outputs it to the controller 9.

The compressed air supply system 7 includes a pressure regulating check valve 11 and an after-cooler 12 (compressed gas cooler) disposed on the downstream side of the pressure regulating check valve 11. The after-cooler 12 cools the compressed air by using cooling air generated by a cooling fan 13. A delivery-side pressure sensor 14 is disposed on the downstream side of the after-cooler 12. The delivery-side pressure sensor 14 senses the delivery-side pressure of the compressor main body 3 and outputs it to the controller 9.

The oil supply system 8 supplies oil to the working chambers of the compressor main body 3 by the pressure difference between the separator 6 and the working chambers of the compressor main body 3. The oil supply system 8 includes an oil cooler 15 (liquid cooler), a bypass route 16 that bypasses the oil cooler 15, a temperature control valve 17 that regulates the flow division ratio of the oil cooler 15 and the flow division ratio of the bypass route 16 according to the temperature of the oil, and an oil filter 18 disposed on the downstream side relative to a merging part at which the oil from the oil cooler 15 and the oil from the bypass route 16 merge. The oil cooler 15 cools oil by using the cooling air generated by the cooling fan 13.

The temperature control valve 17 of the present embodiment is configured in such a manner that there is no case in which the flow division ratio of the oil cooler 15 becomes 0% although it becomes 100% in some cases. However, the temperature control valve 17 may be configured in such a manner that there is a case in which the flow division ratio of the oil cooler 15 becomes 0% as long as the compressor main body 3 is directly cooled with use of part of the cooling air generated by the cooling fan 13, for example.

The controller 9 has a processor that executes processing in accordance with a program and a memory that stores the program and data. The controller 9 controls the above-described electric motor 2, suction throttle valve 5, and cooling fan 13.

Figure 2:
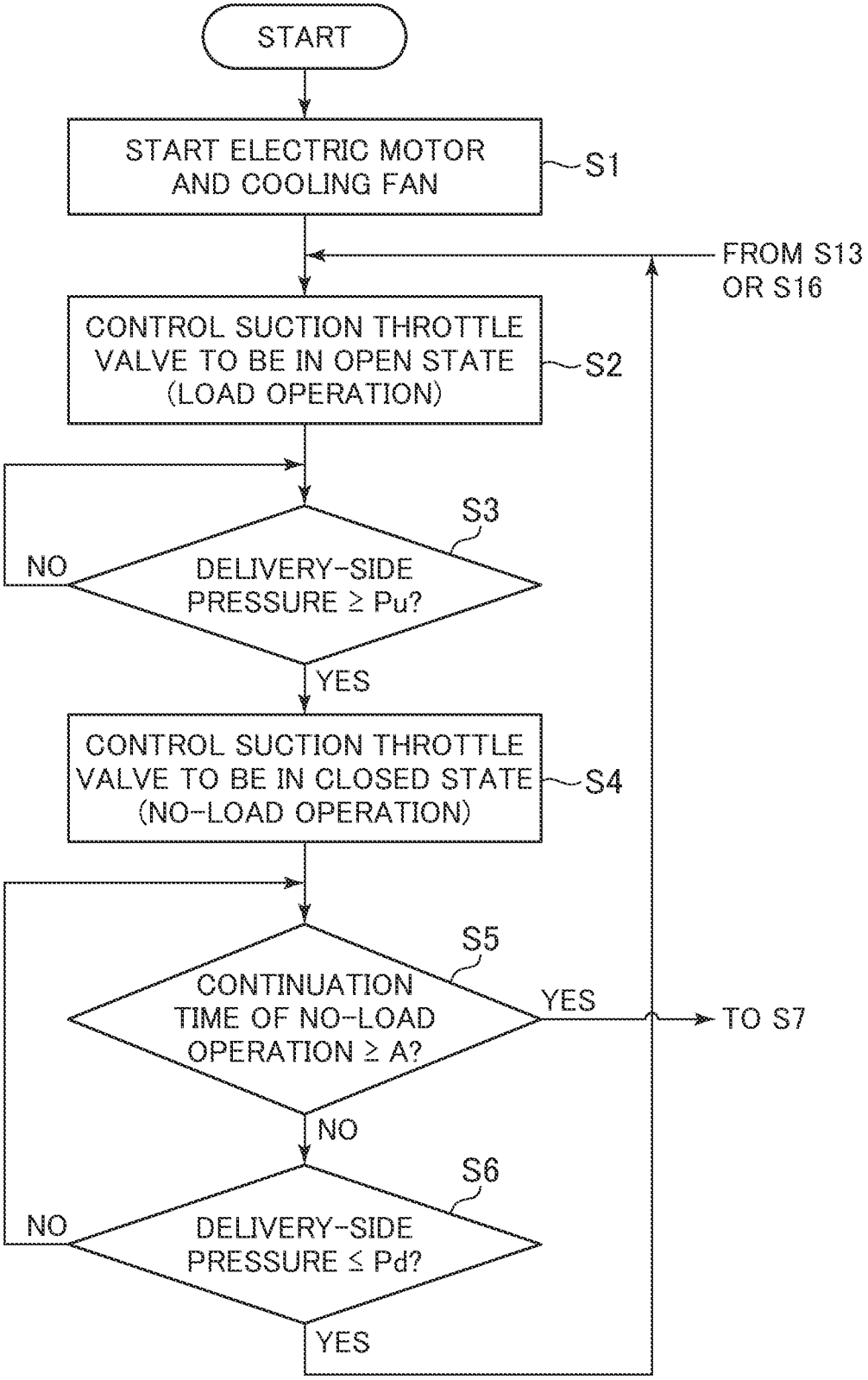
FIG. 2 is a flowchart that represents a control procedure of a suction throttle valve in the first embodiment of the present invention.

Next, the control of the suction throttle valve 5 by the controller 9 of the present embodiment will be described with use of FIG. 2. FIG. 2 is a flowchart that represents the control procedure of the suction throttle valve in the present embodiment.

In response to operation of an operation switch (not illustrated), the controller 9 starts the electric motor 2 and the cooling fan 13 (step S1) and controls the suction throttle valve 5 to be in the open state and execute load operation (step S2).

During the load operation, the controller 9 determines whether or not the delivery-side pressure sensed by the delivery-side pressure sensor 14 has risen to a predetermined upper-limit value Pu (step S3). When the delivery-side pressure sensed by the delivery-side pressure sensor 14 has risen to the predetermined upper-limit value Pu, the controller 9 controls the suction throttle valve 5 to be in the closed state and make switching to no-load operation (step S4).

During the no-load operation, the controller 9 determines whether or not the continuation time of the no-load operation has reached a predetermined value A (step S5) and determines whether or not the delivery-side pressure sensed by the delivery-side pressure sensor 14 has lowered to a predetermined lower-limit value Pd (step S6). When the continuation time of the no-load operation has not reached the predetermined value A and the delivery-side pressure sensed by the delivery-side pressure sensor 14 has lowered to the predetermined lower-limit value Pd, the controller 9 controls the suction throttle valve 5 to be in the open state and make switching to the load operation (step S2).

Figure 3:
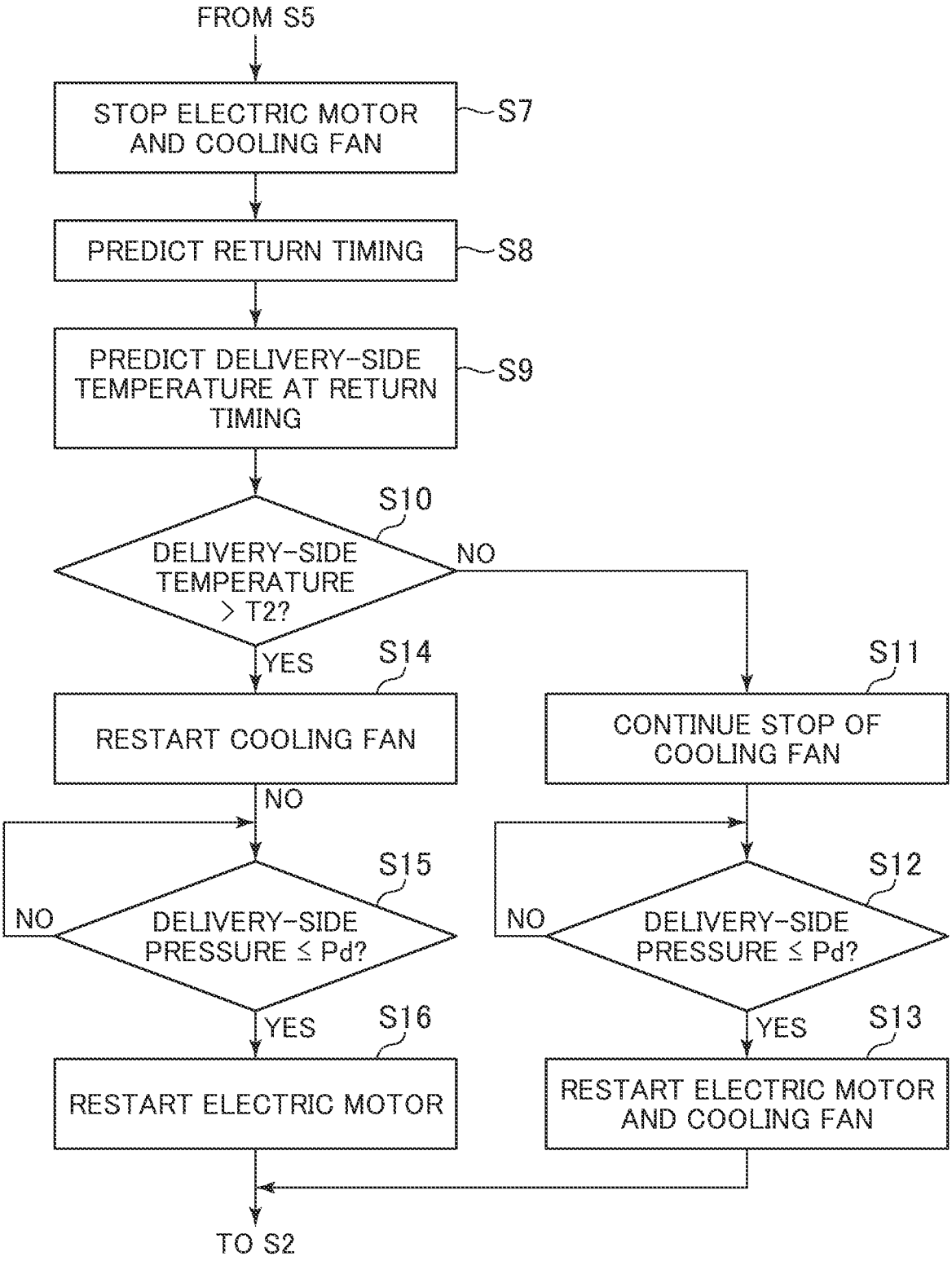
FIG. 3 is a flowchart that represents a control procedure of an electric motor and a cooling fan in the first embodiment of the present invention.

Next, the control of the electric motor 2 and the cooling fan 13 by the controller 9 of the present embodiment will be described with use of FIG. 3. FIG. 3 is a flowchart that represents the control procedure of the electric motor and the cooling fan in the present embodiment.

During the load operation, the controller 9 executes control while varying a target rotation speed of the cooling fan 13 in such a manner that the delivery-side temperature sensed by the delivery-side temperature sensor 10 becomes a predetermined target value T1 (see FIG. 4 to be described later). During the no-load operation, the controller 9 executes control while varying the target rotation speed of the cooling fan 13 in such a manner that the delivery-side temperature sensed by the delivery-side temperature sensor 10 becomes equal to or lower than the predetermined target value T1 and the target rotation speed of the cooling fan 13 becomes equal to or higher than a predetermined minimum value.

When the continuation time of the no-load operation has reached the predetermined value A in step S5 in FIG. 2, the controller 9 stops the electric motor 2 and the cooling fan 13 (step S7). Thereafter, the controller 9 stores a sensing history of each of the delivery-side pressure sensor 14 and the delivery-side temperature sensor 10 in a predetermined period of time. However, a sensing history of the delivery-side pressure sensor 14 during the no-load operation may be stored instead of or in addition to the sensing history of the delivery-side pressure sensor 14 during the stop of the electric motor 2.

After the above-described predetermined period of time has elapsed from the stop of the electric motor 2 and the cooling fan 13, the controller 9 predicts a return timing at which the delivery-side pressure of the compressor main body 3 lowers to the predetermined lower-limit value Pd and the electric motor 2 restarts, on the basis of the above-described sensing history of the delivery-side pressure sensor 14 (step S8). Further, the controller 9 assumes the case of stopping the cooling fan 13 until the return timing and predicts the delivery-side temperature of the compressor main body 3 at the return timing in this case, on the basis of the above-described sensing history of the delivery-side temperature sensor 10 (step S9).

The controller 9 determines whether or not the predicted delivery-side temperature exceeds a predetermined acceptable value T2 (in other words, an initial value of the delivery-side temperature with which the delivery-side temperature of the compressor main body 3 can be suppressed within an acceptable range even when the delivery-side temperature rises in association with an increase in the rotation speed of the electric motor 2) (step S10). When the predicted delivery-side temperature is equal to or lower than the predetermined acceptable value T2, the controller 9 continues the stop of the cooling fan 13 (step S11). Thereafter, when the delivery-side pressure sensed by the delivery-side pressure sensor 14 has reached the predetermined lower-limit value Pd, the controller 9 restarts the electric motor 2 and the cooling fan 13 (steps S12 and S13).

When the predicted delivery-side temperature exceeds the predetermined acceptable value T2, the controller 9 restarts the cooling fan 13 antecedently to the electric motor 2 (step S14). Thereafter, when the delivery-side pressure sensed by the delivery-side pressure sensor 14 has reached the predetermined lower-limit value Pd, the controller 9 restarts the electric motor 2 (steps S15 and S16).

Next, operation and effect of the present embodiment will be described with use of FIG. 4. FIG. 4 is a time chart that represents operation of the electric motor and the cooling fan and a change in the delivery-side pressure and the delivery-side temperature of the compressor main body in the present embodiment.

When a user operates the operation switch (time t1), the electric motor 2 and the cooling fan 13 are started. In addition, the suction throttle valve 5 is controlled to be in the open state. That is, the load operation is executed. Further, the delivery-side pressure of the compressor main body 3 varies according to the balance between the amount of supply of the compressed air from the compressor 1 to the external and the amount of use of the compressed air by the external. According to the variation in the delivery-side pressure of the compressor main body 3, the load operation and the no-load operation are switched.

When the continuation time of the no-load operation has reached the predetermined value A (time t2), the electric motor 2 and the cooling fan 13 stop. When the predetermined period of time has elapsed from the stop of the electric motor 2 and the cooling fan 13 (time t3), the controller 9 predicts the return timing (time t4) at which the electric motor 2 is restarted. Further, the controller 9 assumes the case of stopping the cooling fan 13 until the return timing as illustrated by a dotted line in FIG. 4 and predicts the delivery-side temperature of the compressor main body 3 at the return timing in this case.

Figure 4:
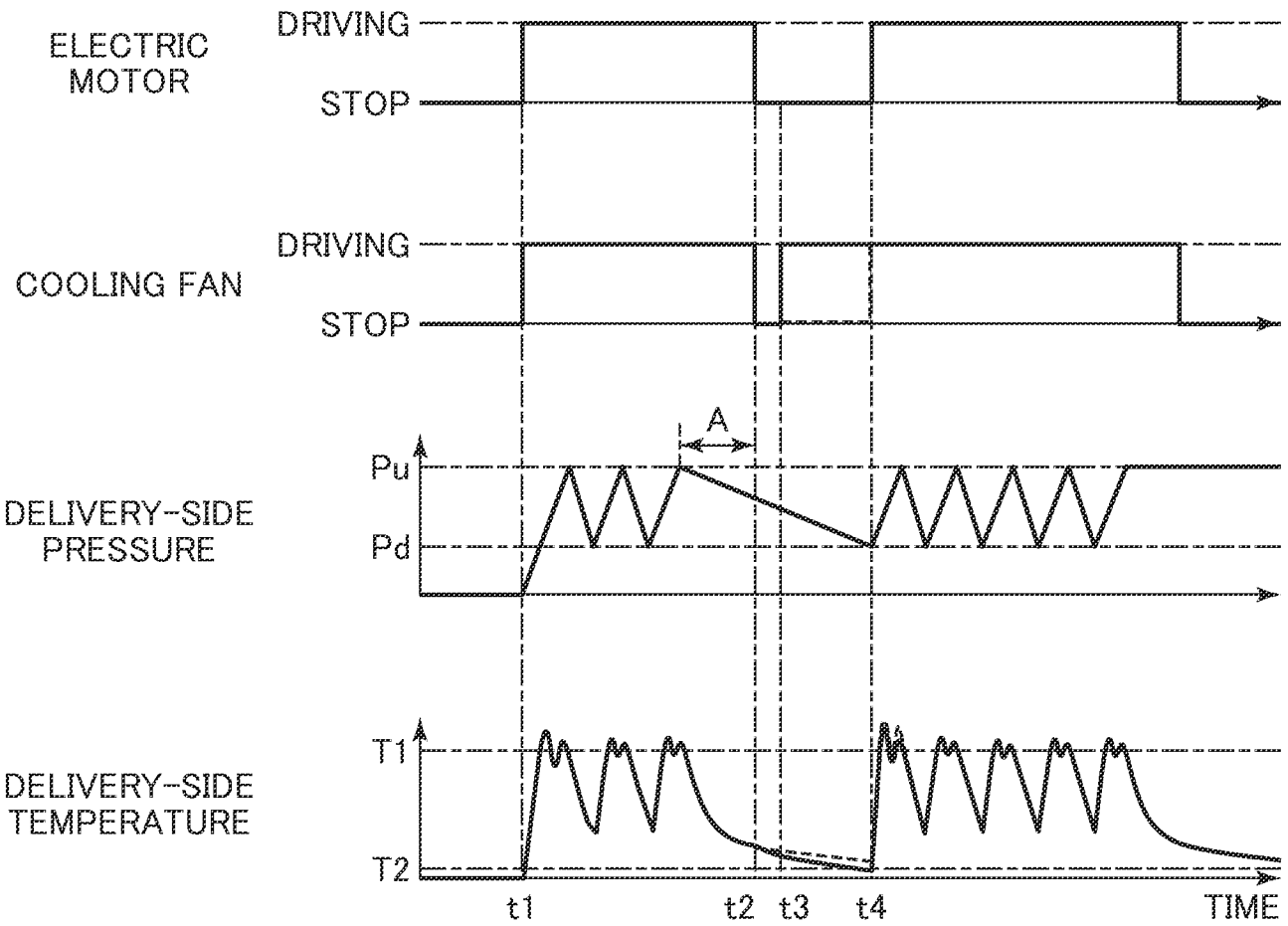
FIG. 4 is a time chart that represents operation of the electric motor and the cooling fan and a change in the delivery-side pressure and the delivery-side temperature of a compressor main body in the first embodiment of the present invention.

The controller 9 restarts the cooling fan 13 antecedently to the electric motor 2 when the delivery temperature of the compressor main body 3 predicted as illustrated by the dotted line in FIG. 4 exceeds the predetermined acceptable value T2. This can suppress the delivery-side temperature of the compressor main body 3 at the return timing to a temperature equal to or lower than the predetermined acceptable value T2 as illustrated by a solid line in FIG. 4. Further, the temperature of the oil can also be lowered. Thus, the delivery-side temperature of the compressor main body 3 does not become excessively high even when the amount of generated heat of the compressor main body 3 sharply increases in association with an increase in the rotation speed of the electric motor 2. As a result, unnecessary warning and stop control can be prevented.

In the first embodiment, description has been made by taking as an example the case in which the controller 9 stores a sensing history of the delivery-side temperature sensor 10 during stop of the cooling fan 13 and thereafter predicts the delivery-side temperature of the compressor main body 3 at the return timing in the case of stopping the cooling fan 13 until the return timing, on the basis of the sensing history of the delivery-side temperature sensor 10. However, the configuration is not limited thereto.

Figure 5:
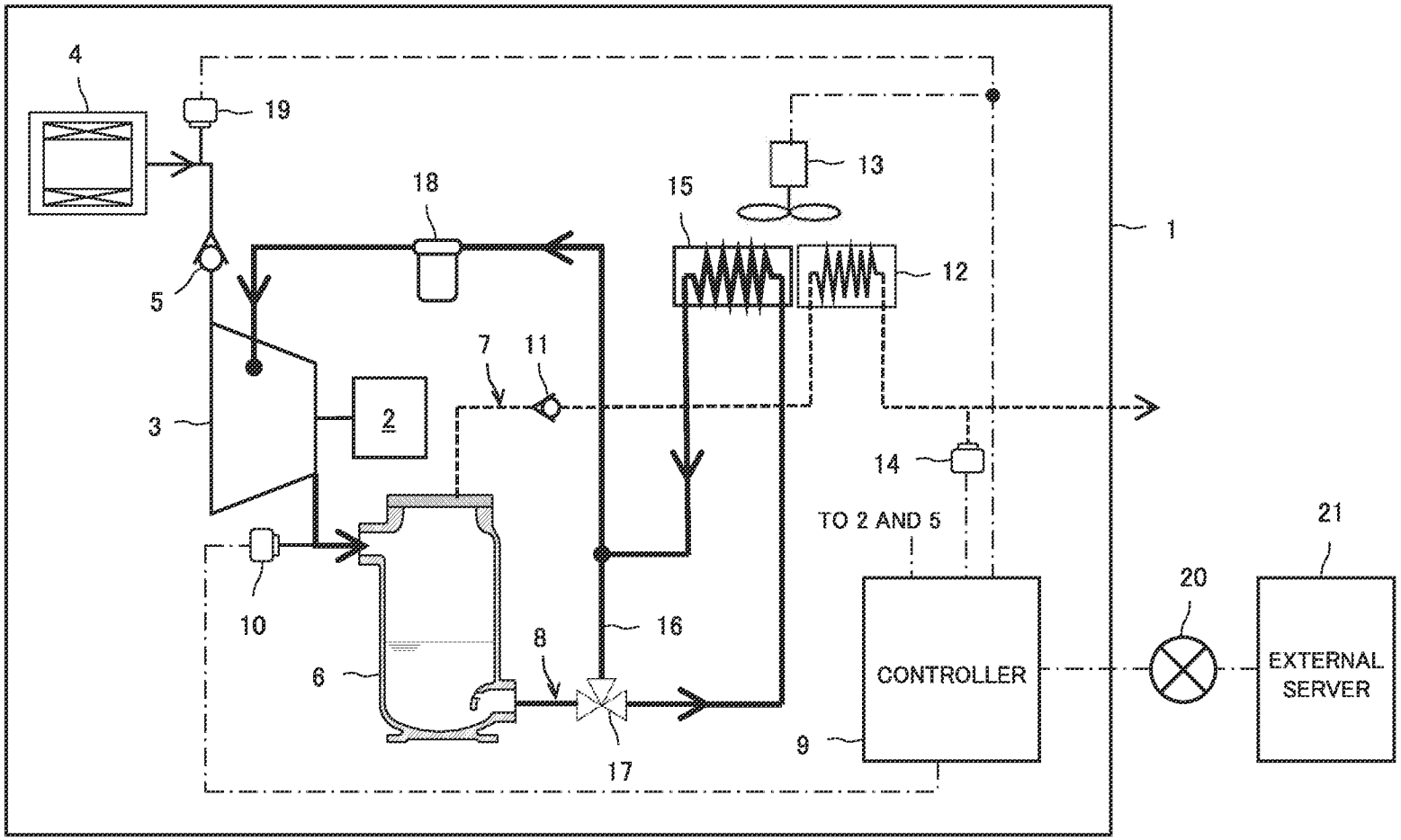
FIG. 5 is a schematic diagram that represents the configuration of the oil-feed-type air compressor in a first modification example of the present invention.

A first modification example of the present invention will be described with reference to a drawing. FIG. 5 is a schematic diagram that represents the configuration of an oil-feed-type air compressor in the present modification example. In the present modification example, a part equivalent to that of the first embodiment is given the same character, and description is omitted as appropriate.

The compressor 1 of the present modification example further includes an intake-side temperature sensor 19 that senses the intake-side temperature of the compressor main body 3.

The controller 9 acquires time-series data concerning the delivery-side temperature of the compressor main body 3 by using a sensing history of the delivery-side temperature sensor 10 during stop of the electric motor 2 and the cooling fan 13. Moreover, the controller 9 acquires the intake-side temperature sensed by the intake-side temperature sensor 19 during the stop of the electric motor 2 and the cooling fan 13. Further, the controller 9 computes the load factor on the basis of the length of time of the load operation and the length of time of the no-load operation before the stop of the electric motor 2 and the cooling fan 13. Then, the controller 9 transmits the above-described time-series data concerning the delivery-side temperature to an external server 21 through a communication network 20, by associating the time-series data with the above-described intake-side temperature and load factor. The external server 21 accumulates a plurality of pieces of the time-series data concerning the delivery-side temperature received from a plurality of compressors 1 together with the corresponding intake-side temperature and load factor.

The controller 9 stops the electric motor 2 and the cooling fan 13 when the continuation time of the no-load operation has reached the predetermined value A, as in the first embodiment. At this time, the controller 9 computes the load factor and acquires pieces of time-series data concerning the delivery-side temperature for which the condition including this load factor and the intake-side temperature sensed by the intake-side temperature sensor 19 is the same from the external server 21 through the communication network 20. Then, the controller 9 predicts the delivery-side temperature of the compressor main body 3 at the return timing in the case of stopping the cooling fan 13 until the return timing, on the basis of the pieces of time-series data concerning the delivery-side temperature acquired from the external server 21.

Also in the present modification example configured as above, effects similar to those of the first embodiment can be obtained.

A second embodiment of the present invention will be described with reference to drawings. The present embodiment is an embodiment in which whether to stop the cooling fan or to continue driving the cooling fan is determined when the continuation time of no-load operation has reached a predetermined value and the electric motor stops. In the present embodiment, a part equivalent to that of the first embodiment (see FIG. 1 and FIG. 2) is given the same character, and description is omitted as appropriate.

Figure 6:
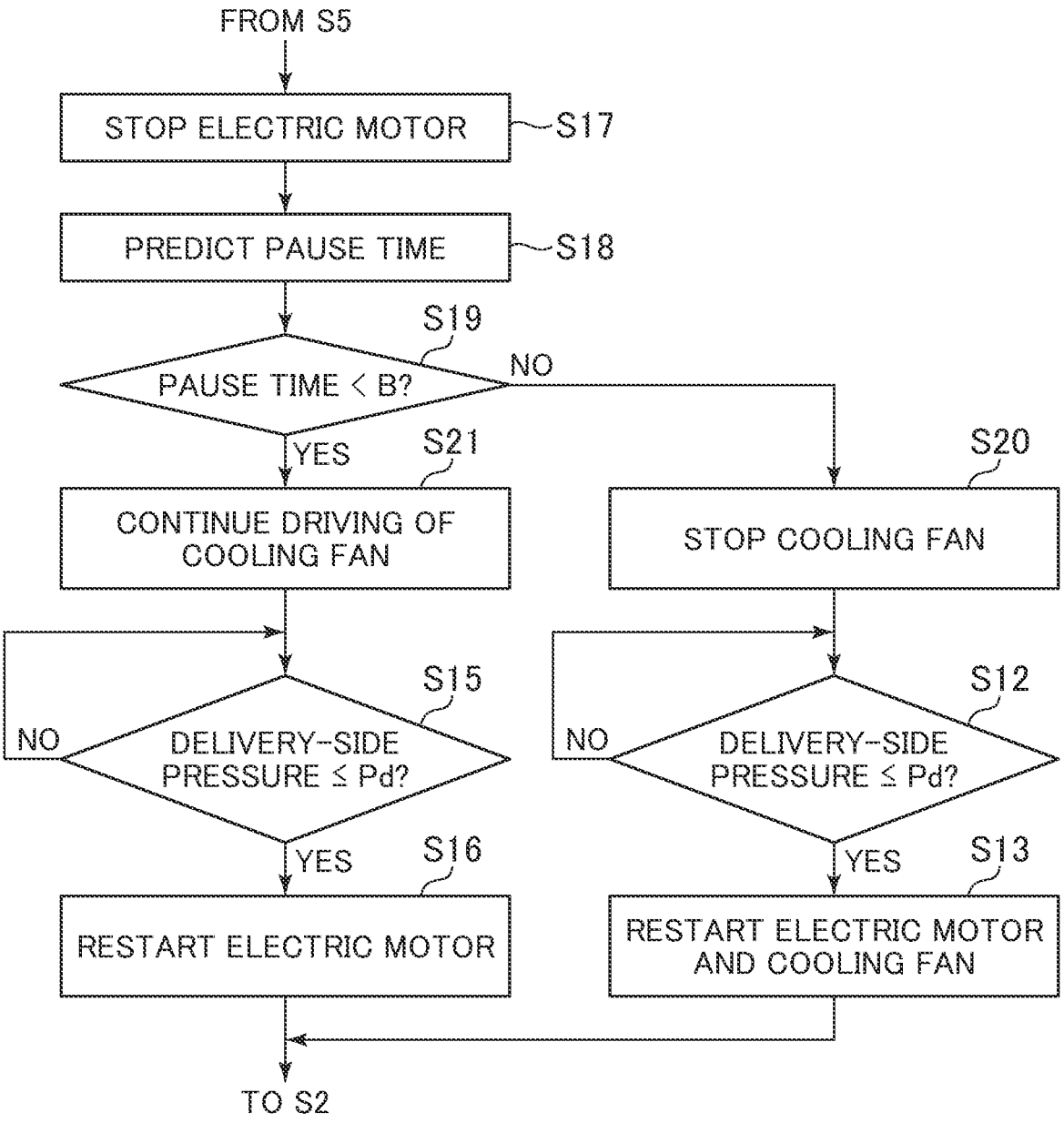
FIG. 6 is a flowchart that represents the control procedure of the electric motor and the cooling fan in a second embodiment of the present invention.

FIG. 6 is a flowchart that represents the control procedure of the electric motor and the cooling fan in the present embodiment.

The controller 9 stops the electric motor 2 when the continuation time of the no-load operation has reached the predetermined value A (step S17). Then, the controller 9 predicts pause time to be taken until the delivery-side pressure of the compressor main body 3 lowers to the predetermined lower-limit value Pd and the electric motor 2 restarts on the basis of a sensing history of the delivery-side pressure sensor 14 during the no-load operation (step S18).

The controller 9 determines whether or not the predicted pause time is equal to or longer than a predetermined acceptable value B (in other words, a minimum value of the pause time with which the delivery-side temperature at the return timing in the case becomes equal to or lower than the predetermined acceptable value T2, this case being assumed of stopping the cooling fan 13 until the return timing) (step S19).

The controller 9 stops the cooling fan 13 when the predicted pause time is equal to or longer than the predetermined acceptable value B (step S20). Thereafter, when the delivery-side pressure sensed by the delivery-side pressure sensor 14 has reached the predetermined lower-limit value Pd, the controller 9 restarts the electric motor 2 and the cooling fan 13 (steps S12 and S13).

The controller 9 continues the driving of the cooling fan 13 when the predicted pause time is shorter than the predetermined acceptable value B (step S21). Thereafter, when the delivery-side pressure sensed by the delivery-side pressure sensor 14 has reached the predetermined lower-limit value Pd, the controller 9 restarts the electric motor 2 (steps S15 and S16).

Figure 7:
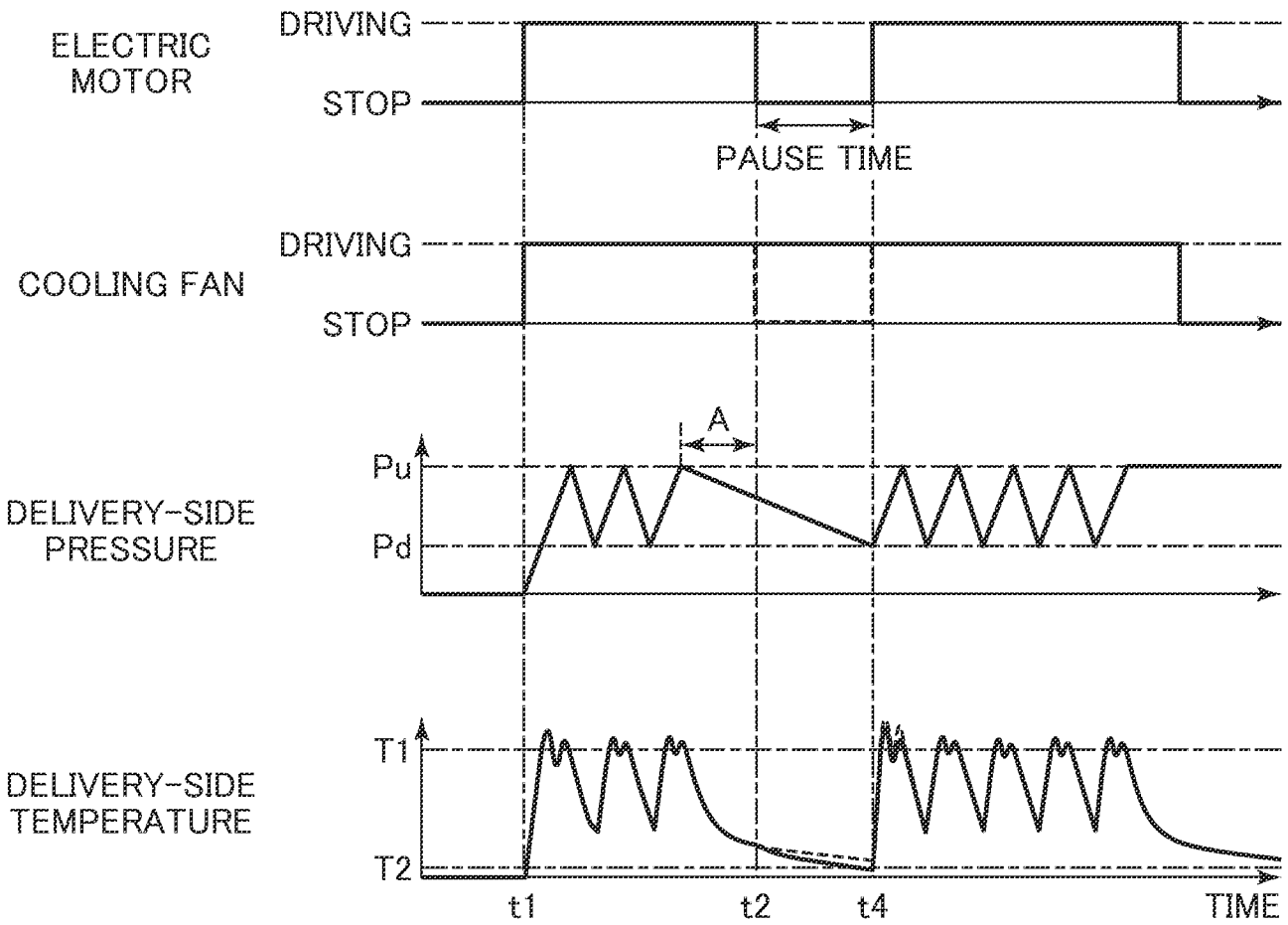
FIG. 7 is a time chart that represents operation of the electric motor and the cooling fan and a change in the delivery-side pressure and the delivery-side temperature of the compressor main body in the second embodiment of the present invention.

Next, operation and effect of the present embodiment will be described with use of FIG. 7. FIG. 7 is a time chart that represents operation of the electric motor and the cooling fan and a change in the delivery-side pressure and the delivery-side temperature of the compressor main body in the present embodiment.

When the continuation time of the no-load operation has reached the predetermined value A (time t2), the electric motor 2 stops. At this time, the controller 9 predicts the pause time of the electric motor 2. The controller 9 continues the driving of the cooling fan 13 when the predicted pause time is shorter than the predetermined acceptable value B. In other words, the driving of the cooling fan 13 is continued in the case in which the delivery-side temperature at the return timing (t4) exceeds the predetermined acceptable value T2 if the cooling fan 13 is stopped as illustrated by a dotted line in FIG. 7. This can suppress the delivery-side temperature of the compressor main body 3 at the return timing to a temperature equal to or lower than the predetermined acceptable value T2 as illustrated by a solid line in FIG. 7. Further, the temperature of the oil can also be lowered. Thus, the delivery-side temperature of the compressor main body 3 does not become excessively high even when the amount of generated heat of the compressor main body 3 sharply increases in association with an increase in the rotation speed of the electric motor 2. As a result, unnecessary warning and stop control can be prevented.

Figure 8:
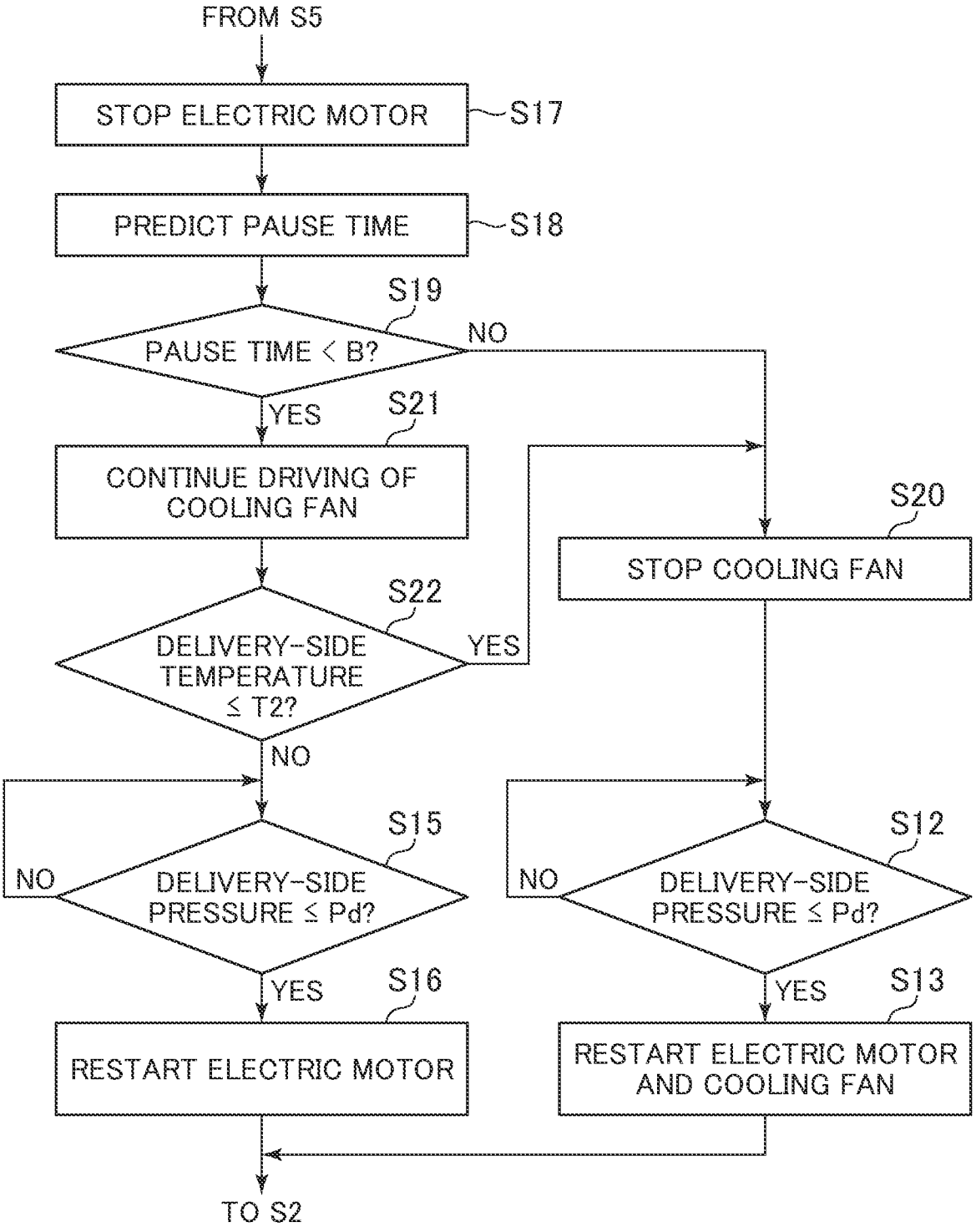
FIG. 8 is a flowchart that represents the control procedure of the electric motor and the cooling fan in a second modification example of the present invention.

In the second embodiment, although description has not particularly been made, for example, as in a second modification example illustrated in FIG. 8, the controller 9 may determine whether or not the delivery-side temperature sensed by the delivery-side temperature sensor 10 is equal to or lower than the predetermined acceptable value T2 (step S22) after continuing the driving of the cooling fan 13 in step S21 (in other words, during the stop of the electric motor 2 and the driving of the cooling fan 13). Then, when the delivery-side temperature sensed by the delivery-side temperature sensor 10 is equal to or lower than the predetermined acceptable value T2, the controller 9 stops the cooling fan 13 (step S20). On the other hand, when the delivery-side temperature sensed by the delivery-side temperature sensor 10 exceeds the predetermined acceptable value T2, the controller 9 continues the driving of the cooling fan 13 (step S21). Also in such a modification example, effects similar to those of the second embodiment can be obtained. Further, the driving time of the cooling fan 13 can be reduced, and energy saving can be sought, compared with the second embodiment.

Further, in the first and second embodiments and the first and second modification examples, description has been made by taking as an example the case in which the controller 9 executes control while varying the target rotation speed of the cooling fan 13 according to the sensing result of the delivery-side temperature sensor 10. However, the configuration is not limited thereto. The controller 9 may execute control while fixing the target rotation speed of the cooling fan 13 irrespective of the sensing result of the delivery-side temperature sensor 10.

In the above, description has been made by taking as an example the case in which the present invention is applied to an oil-feed-type air compressor (that is, one that compresses air while supplying oil to working chambers). However, the configuration is not limited thereto. The present invention may be applied to a different type of liquid-feed-type gas compressor (that is, one that supplies a different kind of liquid that is other than oil to working chambers or one that compresses a different kind of gas that is other than air).

DESCRIPTION OF REFERENCE CHARACTERS

1: Oil-feed-type air compressor
2: Electric motor
3: Compressor main body
5: Suction throttle valve
6: Separator
8: Oil supply system (liquid supply system)
9: Controller
10: Delivery-side temperature sensor
13: Cooling fan
14: Delivery-side pressure sensor
15: Oil cooler (liquid cooler)
19: Intake-side temperature sensor
21: External server

The invention claimed is:

1. A liquid-feed-type gas compressor comprising:
an electric motor;
a compressor main body that is driven by the electric motor and compresses gas while supplying liquid to working chambers;
a suction throttle valve disposed on an intake side of the compressor main body;
a separator that separates the liquid from the compressed gas delivered from the compressor main body;
a liquid supply system that supplies the liquid separated by the separator to the working chambers of the compressor main body;
a cooling fan;
a liquid cooler that is disposed in the liquid supply system and cools the liquid by using cooling air generated by the cooling fan;
a delivery-side pressure sensor that senses a delivery-side pressure of the compressor main body; and
a controller that controls the electric motor, the suction throttle valve, and the cooling fan, wherein
the controller is configured to:
control the suction throttle valve to make switching from load operation to no-load operation when the delivery-side pressure sensed by the delivery-side pressure sensor has risen to a predetermined upper-limit value during driving of the electric motor; and
stop the electric motor when continuation time of the no-load operation has reached a predetermined value and then restart the electric motor and control the suction throttle valve to make switching to the load operation when the delivery-side pressure sensed by the delivery-side pressure sensor has lowered to a predetermined lower-limit value, and
the controller is configured to:
stop the cooling fan when the continuation time of the no-load operation has reached the predetermined value and the electric motor stops;
predict a return timing at which the delivery-side pressure of the compressor main body lowers to the predetermined lower-limit value and the electric motor restarts, on a basis of a sensing history of the delivery-side pressure sensor during the stop of the electric motor or the no-load operation, and predict a delivery-side temperature of the compressor main body at the return timing in a case of stopping the cooling fan until the return timing; and
continue the stop of the cooling fan when the predicted delivery-side temperature is equal to or lower than a predetermined acceptable value, and restart the cooling fan antecedently to the electric motor when the predicted delivery-side temperature exceeds the predetermined acceptable value.

2. The liquid-feed-type gas compressor according to claim 1, comprising:
a delivery-side temperature sensor that senses the delivery-side temperature of the compressor main body, wherein
the controller is configured to:
store a sensing history of the delivery-side temperature sensor during the stop of the cooling fan; and
then predict the delivery-side temperature of the compressor main body at the return timing in the case of stopping the cooling fan until the return timing, on a basis of the sensing history of the delivery-side temperature sensor.

3. The liquid-feed-type gas compressor according to claim 1, further comprising:
an intake-side temperature sensor that senses an intake-side temperature of the compressor main body; and
the controller is configured to:
compute a load factor on a basis of a length of time of the load operation and a length of time of the no-load operation before the stop of the electric motor and the cooling fan;
acquire, from an external server, pieces of time-series data for which the delivery-side temperature, for a condition including the computed load factor, and the intake-side temperature sensed by the intake-side temperature sensor is the same during the stop of the electric motor and the cooling fan; and
predict the delivery-side temperature of the compressor main body at the return timing in the case of stopping the cooling fan until the return timing, on a basis of the pieces of time-series data concerning the delivery-side temperature.

* * * * *